US006223382B1

(12) United States Patent
Schwab

(10) Patent No.: US 6,223,382 B1
(45) Date of Patent: May 1, 2001

(54) BACK AND BODY WASHER

(76) Inventor: Paul D. L. Schwab, 9705 215th St. North, Forest Lake, MN (US) 55025

( * ) Notice: Subject to any disclaimer, the term of this patent is extended or adjusted under 35 U.S.C. 154(b) by 0 days.

(21) Appl. No.: 09/374,426

(22) Filed: Aug. 13, 1999

(51) Int. Cl.[7] ..... A47K 7/02
(52) U.S. Cl. ..... 15/222; 601/137; 601/143
(58) Field of Search ..... 15/222; 401/6, 401/8; 601/137, 138, 143

(56) References Cited

U.S. PATENT DOCUMENTS 4,234,994 * 11/1980 Schwab ..... 15/222
5,983,436 * 11/1999 Mason et al. ..... 15/222

* cited by examiner

*Primary Examiner*—Mark Spisich
(74) *Attorney, Agent, or Firm*—Jacobson & Johnson

(57) ABSTRACT

A flexible hand holdable cloth for washing a user's body with the cloth including a first handle to provide a first finger grasping region thereon and a second extendible handle having a contracted condition wherein the second handle is maintained proximate the flexible cloth so that the second handle does not interfere with the use of the flexible cloth as a hand holdable body cloth and an extended condition to enable a user to grasp and extend the second handle while holding onto the first handle to enable the user to rub the flexible cloth on the user's back with a back and forth motion. The extendible handle is further usable to retain the cloth in a display or storage condition by contracting the handle around the cloth when the cloth is in a rolled condition.

18 Claims, 4 Drawing Sheets

BACK AND BODY WASHER

FIELD OF THE INVENTION

This invention relates generally to improvement in body washing articles and, more specifically, to a back and body washer that allows the user convenient one hand or two hand use thereof.

BACKGROUND OF THE INVENTION

The concept of back and body washers is old in the art. Typically, a body cloth includes a pair of handles so that a user can reach behind his or her back and grasp one handle with one hand and the other handle with the other hand. The user can then, with a back and forth motion of his or her arms, rub the body cloth across the user's back. In order to provide sufficient length so that the user can rub the body cloth across the user's back, usually one or both of the handles comprise straps that extend outward from the body cloth up to a foot or more in length. While the two straps provide excellent means for grasping and holding the body cloth so that the body cloth can be pulled back and forth on a user's body, it makes for an unwieldy cumbersome product, and it has been found that consumers are reluctant to purchase and use the back and body washer in that form. However, it has also been found that when an elongated strap handle is replaced with a retractable or stretchable handle, consumers can readily accept the back and body washer as a hand held body cloth.

SUMMARY OF THE INVENTION

Briefly, the present invention is a flexible hand holdable cloth for washing a user's body with the cloth including a first handle to provide a first finger grasping region thereon and a second extendible handle having a normally contracted condition wherein the second handle is maintained proximate the flexible cloth so that the second handle does not interfere with the use of the flexible cloth as a hand holdable body cloth and an extended condition to enable a user to grasp the second handle while holding onto the first handle to thereby enable the user to rub the flexible cloth on the user's back with a back and forth motion. The second extendible handle can be further used to maintain the flexible hand holdable cloth in a rolled condition for display or storage of the body cloth.

DESCRIPTION OF THE PRIOR ART

U.S. Pat. No. 3,875,933 illustrates a back washer with mesh fabric and two long tape loops.

U.S. Pat. No. 4,187,575 shows a back washer with multiple scrubber strips.

U.S. Pat. No. 4,234,994 illustrates a back washer with a long handle and a short handle.

U.S. Pat. No. 4,512,054 shows a back scrubber with transverse pleats.

U.S. Pat. No. 5,386,609 illustrates a back washer two elongated handles and a loofah pad.

U.S. Pat. No. 5,504963 illustrates a back washer having interwoven loops of netting and two short handles.

U.S. Pat. No. 5,509,164 illustrates a body washer with mitts on the ends.

U.S. Pat. No. 5,537,709 illustrates a back scrubbing device with a plurality of mounting members.

U.S. Pat. No. 5,545,456 shows a wash clothe made of two sheets of flexible material and two fixed handles.

U.S. Pat. No. 5,850,662 illustrates an elastic plastic scrubber with two handles and one or more sections located thereon.

DESCRIPTION OF THE PREFERRED EMBODIMENT

Figure 1:
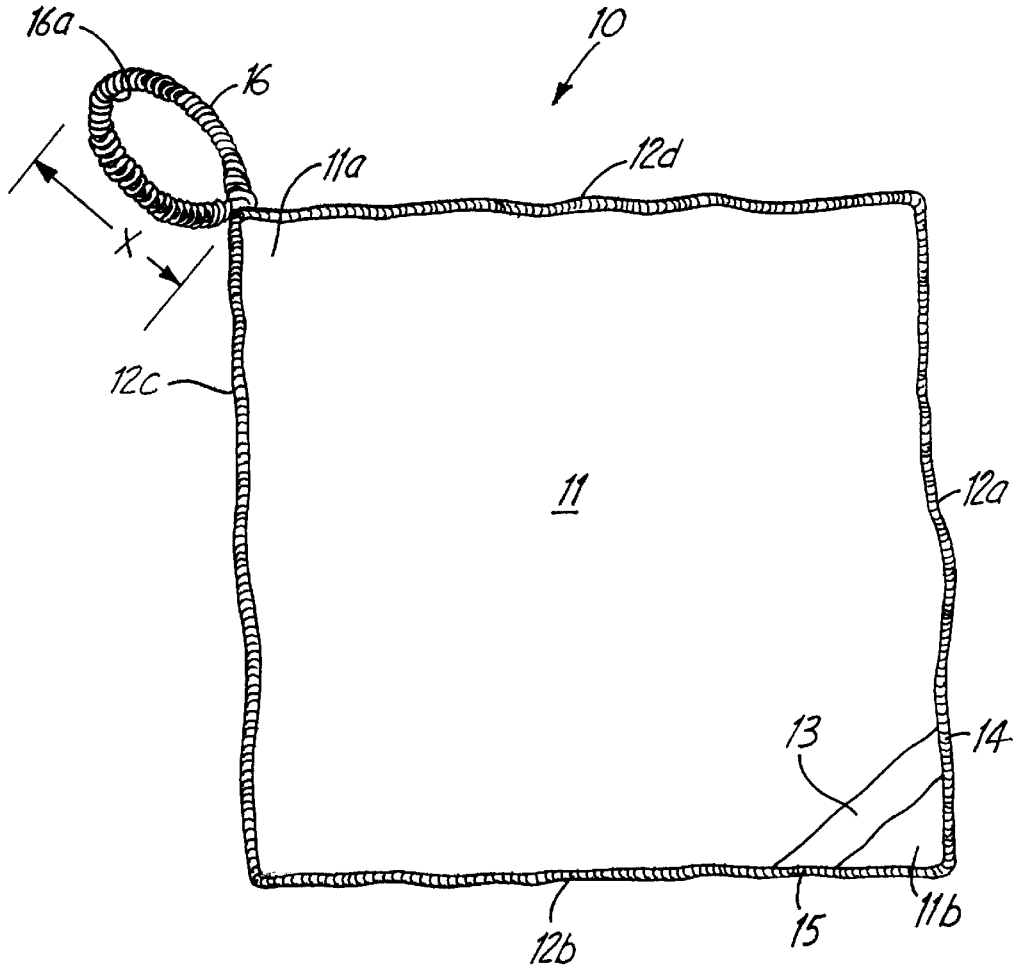
FIG. 1 shows a front view of the back and body washer of the present invention.

Referring to FIG. 1, reference numeral 10 identifies the improved back and body washer comprising a generally rectangular flexible cloth 11 with the flexible cloth having a surface thereon for rubbing over a user's back and body. The flexible cloth 11 has a first edge 12*a*, a second edge 12*b*, a third edge 12*c* and a fourth edge 12*d*. Edge 12*a* and edge 12*b* meet to define a first end 11*b* of the flexible cloth and edge 12*c* and 12*d* meet to define a second end 11*a* of the flexible cloth with the two ends diagonally opposite from each other. A first handle 13 comprising a flexible cloth strap is secured to the first end of flexible cloth 11. Cloth strap end 14 is secured to edge 12*a* through stitching or the like and similarly cloth strap end 15 is secured to edge 12*b*. The securing of ends 14 and 15 to flexible cloth 11 provides a first finger grasping region for holding the first end of said flexible cloth when the cloth is used as a back washer.

Located on the diagonal opposite end of flexible cloth 11 is a second handle 16 which is secured to the second end 11*a* to provide a second finger griping region 16*a* for holding the second end of the flexible cloth. The second handle 16 comprising a stretchable member, having a normally contracted condition wherein the handle is maintained proximate the flexible cloth so that the stretchable member does not interfere with the use of the flexible cloth as a hand held body cloth. That is, the second handle extends a distance x from the flexible cloth where the distance x is generally on the order of about 2 to 4 inches or less. In the preferred embodiment the second handle is sufficiently short so that the entire handle can be grasped in the user's palm without having to wind or roll up the handle. In the condition shown in FIG. 1 the back and body washer can be conveniently used as a conventional body cloth by grasping the cloth in one hand and rubbing the cloth over the user's body. As the handle 16 is sufficiently small so that it can be either grasped in the users hand or can be allowed to hang free while the user washes his or her body. That is, the handle 16 does not catch on or wrap around body parts or on shower equipment since the handle 16 has a small opening therein and does not extend far from the cloth.

Generally, the handles 13 and 16 are positioned on the bias of the flexible cloth to provide a resiliency to the back and body washer.

Figure 2:
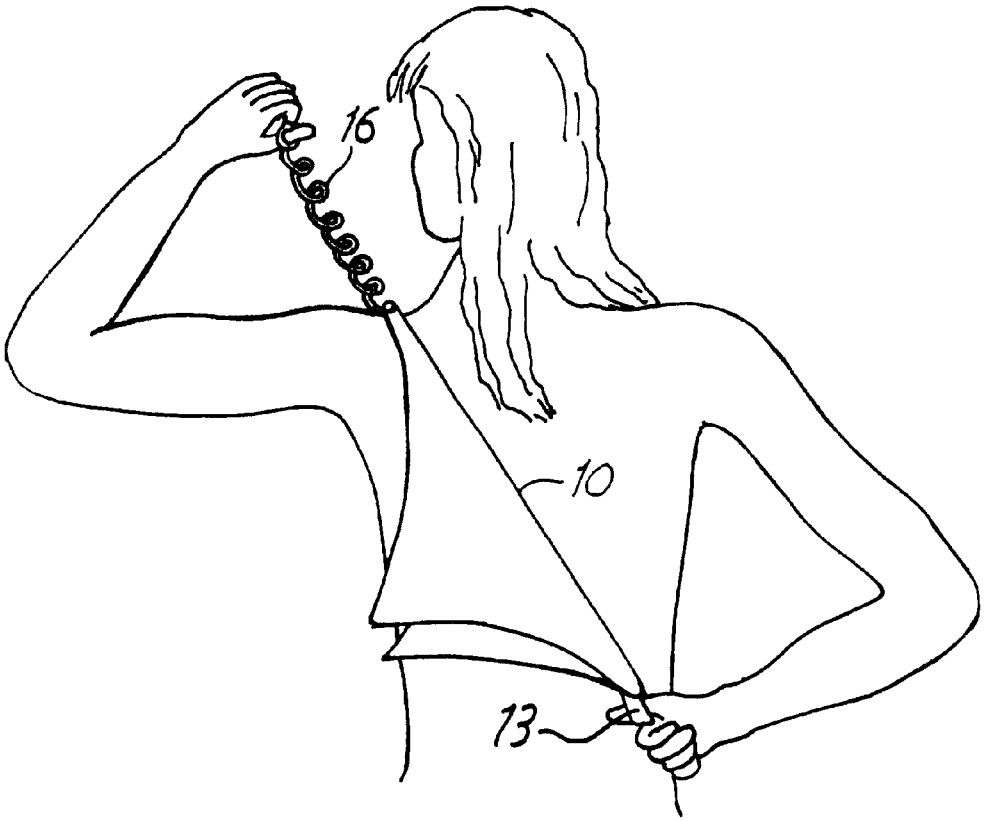
FIG. 2 shows the back and body washer of FIG. 1 in use with the stretchable handle extended to enable use of the back and body washer as a back washer or scrubber.

While the second handle 16 has been found to greatly increase the desirability of the use of flexible cloth as a conventional body cloth, it also allows the body cloth 10 to be used as a back washer. FIG. 2 shows the second handle 16 is stretchable to an extended condition to enable a user to grasp the first handle 13 with the fingers of one hand and the second handle 16 with the fingers of the other hand to thereby enable the user to rub the flexible cloth on the user's back with a back and forth motion.

Figure 3:
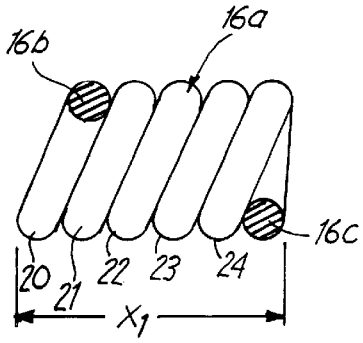
FIG. 3 shows a portion of the coils forming extendible handle of the back and body washer.
Figure 3A:
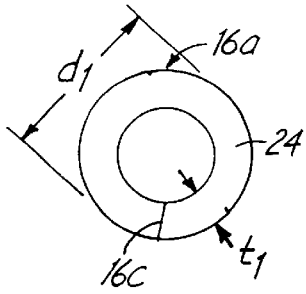
FIG. 3*a* shows an end view of the coils shown in FIG. 3.

In order to appreciate the second handle reference should be made to FIG. 3, FIG. 3*a* FIG. 4 and FIG. 5. FIG. 3 shows a section 16*a* of handle 16. Handle 16 is shown to comprise a compact series of connected coils 20, 21, 22, 23, and 24 which are located in a side by side relationship. FIG. 3*a* shows an end view of section 16a with coil 24 shown to have a cross-section diameter of thickness $t_1$,the coils are shown to have an outside diameter $d_1$. Thus, handle 16 is formed from a plurality of coils with the coils forming a take up mechanism for reducing the length of the handle 16 when the handle 16 is not in use. That is, handle 16 is stretchable to a use condition as a back and body washer as shown in FIG. 2.

Figure 4:
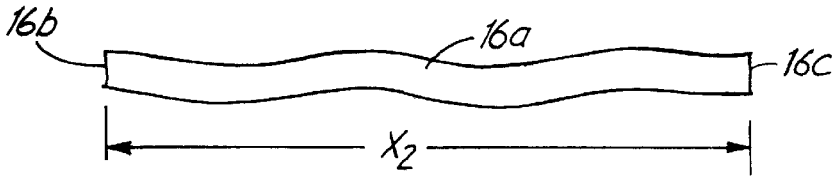
FIG. 4 shows the portion of the coils shown in FIG. 3 extended sufficiently far until the coils have been substantially eliminated.
Figure 5:
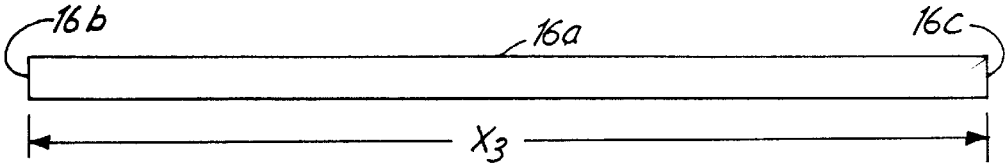
FIG. 5 shows the portion of the coils shown in FIG. 3 extended sufficiently far so that the elastic core therein has been stretched.

Handle 16 comprises a compound handle that provides substantial elongation. To observe the compound elongation of handle 16 reference should be made to FIG. 3 which shows a handle section 16*a* extending a distance $x_1$. FIG. 4 shows the same handle section extended so as to straighten out the coils. In this condition the handle section 16*a* extends a distance $x_2$. FIG. 5 shows the section 16*a* stretched to a second condition with the length of section 16*a* indicated by $x_3$. In FIG. 5 the ability of the section 16*a* to elongate is due to the use of elastic fibers within the core of the coil.

Figure 6:
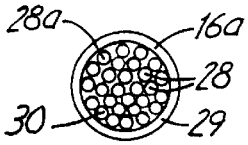
FIG. 6 shows a cross-sectional view of the second handle.

FIG. 6 shows a cross-section of a coil 16*a* having an elastic cord 30 formed from a plurality of elastic fibers 28 located therein which are covered by a layer of stretchable cloth 29. If one wants to limit the stretch of the elastic fibers 28 a non elastic member 28*a* can be bundled with the elastic fibers. Thus the size or the compactness of handle 16 can be greatly reduced by forming the stretchable material in the form of a coil. Consequently, the second handle 16 forms a compound handle that is partially elongateable due to the plurality of coils being uncoiled and partially elongateable as the elastic material therein is stretched. With the present configuration the handle can be stretched on a ratio of about 7 to 1. Thus, a two inch handle extending from one end of the flexible cloth can be extended a distance on the order of 14 inches.

Figure 7:
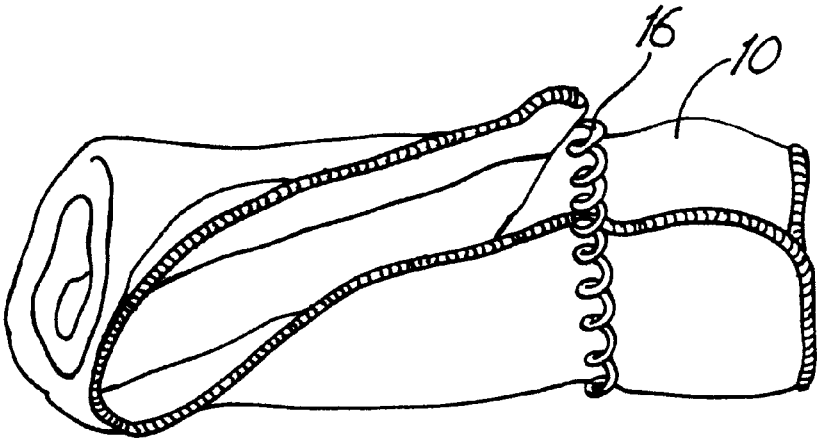
FIG. 7 shows how the second handle can be placed around the flexible body cloth to hold the body cloth neatly in place.

FIG. 7 shows another feature of the invention, the compact storage of the flexible body cloth 10. The flexible body cloth 10 is shown rolled into a cylindrical roll with the end having the coiled stretchable handle 16 located on the outside of the roll. Handle 16 forms a retainer for maintaining the integrity of the body cloth in a cylindrical roll, which makes it convenient for both display and storage of the invention. As the handle 16 is stretchable the handle can contract around the cylindrical roll to tightly hold the roll in place It will be envisioned that in a preferred embodiment the hand holdable cloth can be made from materials such as cotton and the fabric covering on the extendible handle can be cotton of a compatible color so that both the body of the cloth and the handle project a unity of appearance.

With the present invention the combination of an extendible handle 16 and a non-extendible handle 13 converts the body cloth 11 into a user friendly body cloth that can be used equally effectively as either a back washer or a body washer.

I claim:

1. A back and body washer comprising:

a flexible cloth, said flexible cloth having a surface thereon for rubbing over a user's back and body, said flexible cloth having a first end and a second end;

a first handle secured to said first end of said flexible cloth to provide a first finger grasping region for holding said first end of said flexible cloth; and a second handle, said second handle secured to said second end to provide a second finger gripping region for holding said second end of said flexible cloth, said second handle comprising a stretchable member, said second handle having a contracted condition wherein the second handle is maintained proximate the flexible cloth so that the flexible cloth does not interfere with the use of the flexible cloth as a hand held body cloth, said second handle stretchable to an extended condition to enable a user to grasp the first handle with the fingers of one hand and the second handle with the fingers of the other hand to enable the user to rub the flexible cloth on the user's back with a back and forth motion.

2. A back and body washer comprising;

a flexible body cloth for washing a user's body, said flexible body cloth having a first end and a second end;

a first handle secured to said first end of said flexible body cloth, said first handle proximate the body cloth;

a second handle, said second handle comprising a stretchable material, said stretchable material normally contracted so as not to interfere with use of the body cloth as a hand held body cloth, said second handle stretchable to a second condition.

3. The back and body washer of claim 2 wherein the second handle comprising a cloth covered elastic material.

4. The back and body washer of claim 3 wherein the covering of the second handle is cotton.

5. The back and body washer of claim 2 wherein the second handle comprises a compound stretchable material.

6. The back and body washer of claim 5 wherein the flexible body cloth is substantially rectangular in shape.

7. The back and body washer of claim 5 wherein the first handle is mounted on a first corner of said flexible cloth.

8. The back and body washer of claim 7 wherein the second handle is mounted on a second corner, said second corner diagonally opposite from said first corner.

9. The back and body washer of claim 8 wherein the first handle comprises a cloth strap having a first end and a second end secured to said flexible cloth to form a loop for finger engagement therewith.

10. The back and body washer of claim 7 wherein the flexible cloth has a surface area of less than two square feet.

11. The back and body washer of claim 7 wherein the flexible cloth is cotton.

12. The back and body washer of claim 7 wherein said flexible cloth is wound into a cylindrical roll and said second handle is contracted around the cylindrical roll to prevent the cylindrical roll from unwinding.

13. The back and body washer of claim 7 wherein the cloth has a bias direction and the handles are fastened on the bias of the flexible cloth to provide resiliency to said back and body washer.

14. The back and body washer of claim 2 wherein the flexible cloth forms a cylindrical roll in a wound condition when held by the stretchable handle.

15. A back and body washer comprising:

a flexible cloth, said flexible cloth having a surface thereon for rubbing over a user's back and body, said flexible cloth having a first end and a second end;

a first handle secured to said first end of said flexible cloth to provide a first finger grasping region for holding said first end of said flexible cloth; and a second handle, said second handle secured to said second end to provide a second finger gripping region for holding said second end of said flexible cloth, said second handle comprising a plurality of coils that when stretched, elongate to lengthen the second handle to a first length which is at least 7 times its original length, said second handle having a contracted condition wherein the second handle is maintained proximate the flexible cloth so that the flexible cloth does not interfere with the use of the flexible cloth as a hand held body cloth, said second handle stretchable to an extended condition to enable a user to grasp the first handle with the fingers of one hand and the second handle with the fingers of the other hand to enable the user to rub the flexible cloth on the user's back with a back and forth motion.

16. The back and body washer of claim 15 wherein the coils contain an elastic material to enable extending the second handle to a longer length.

17. A back and body washer comprising:

a flexible hand holdable cloth for washing a user's body;

a first handle on a first end of said flexible hand holdable cloth to provide a finger grasping region thereon; and a compound handle on the second end of said flexible hand holdable cloth with said compound handle comprising an elastic cord having a plurality of coils therein, said compound handle partially elongateable as the plurality of coils are stretched out and partially elongateable as the elastic material therein is stretched.

18. The back and body washer of claim 17 where the first handle is non-extendible.

* * * * *